United States Patent [19]

Kay et al.

[11] 4,166,644

[45] Sep. 4, 1979

[54] PRESSURE-SENSITIVE RECORD MATERIAL CONTAINING UREA-FORMALDEHYDE RESIN PIGMENT

[75] Inventors: Daniel J. Kay; Rashmikant R. Patel, both of Appleton, Wis.

[73] Assignee: NCR Corporation, Dayton, Ohio

[21] Appl. No.: 808,560

[22] Filed: Jun. 21, 1977

[51] Int. Cl.[2] ..... B41L 1/36

[52] U.S. Cl. ..... 282/27.5; 428/307; 428/325; 428/326; 428/327; 428/531; 428/535; 428/914

[58] Field of Search ..... 282/27.5; 428/323, 325, 428/452, 531, 914, 307, 326, 327, 535

[56] References Cited

U.S. PATENT DOCUMENTS

| | | | |
|---|---|---|---|
| 3,617,410 | 11/1971 | Clark | 428/452 |
| 3,723,156 | 3/1973 | Brockett et al. | 282/27.5 |
| 3,927,237 | 12/1975 | Sund | 428/325 |
| 3,952,132 | 4/1976 | Kato et al. | 428/323 |
| 3,988,522 | 10/1976 | Berstein | 428/323 |

*Primary Examiner*—Thomas J. Herbert, Jr.

*Attorney, Agent, or Firm*—Birch, Stewart, Kolasch and Birch

[57] ABSTRACT

Improved print speed and image intensity are obtained in a pressure-sensitive record sheet material by incorporating a cross-linked urea-formaldehyde agglomerated resin pigment in the coated surface of the acid-reacting sheet. A typical formulation of the coating comprises kaolin clay, a zinc-modified phenol-formaldehyde resin, said urea-formaldehyde resin pigment and a suitable binder. When contacted under pressure with a surface containing microscopic rupturable capsules of a colorless chromogeneous material, a colored mark is formed by transfer of the colorless chromogeneous material to the acidic pigment coating.

12 Claims, No Drawings

PRESSURE-SENSITIVE RECORD MATERIAL CONTAINING UREA-FORMALDEHYDE RESIN PIGMENT

BACKGROUND OF THE INVENTION

This invention relates to pressure-sensitive record material sheets. More particularly, the invention is directed toward pressure-sensitive record material containing a urea-formaldehyde resin pigment as a substitute for all or a part of the usual pigmentary coating on the acid-reactive surface.

Many attempts have been made in the prior art to whiten the surface of pressure-sensitive record sheets while also improving the intensity of the dye images formed. Coatings of a white pigment such as $CaCO_3$ (chalk) are conventionally employed in the art. Acid-reactant pigments such as various clays, zeolites and colloidal silica have also been used in record sheets for many years. Such record sheets, when placed in contiguous relationship with a transfer sheet surface containing microscopic rupturable capsules of a colorless chromogeneous material, produce an image under pressure which causes the capsules to break, whereby some of the colorless chromogeneous material is transformed to the acidic pigment coating where it reacts to give a colored mark.

U.S. Pat. No. 3,617,410 of Clark describes pressure-sensitive record sheets having improved resistance to smudging wherein the conventional acidic pigments employed are replaced by high-bulking pigments which are substantially non-reactive with the basic dyes in the colorless marking ink, such as hydrated alumina, high-bulking filler clay and talc pigments. While providing satisfactory print intensity, such record material has other disadvantages.

One of the objects of the present invention is to provide pressure-sensitive record material having a greatly improved image intensity.

Another object of the invention is to provide pressure-sensitive record material having a very high print speed, i.e., the rate at which full color intensity is realized when acid-reacting sheets are treated with oil solutions of base-reacting chromogens.

Still another object of the invention is to provide pressure-sensitive record sheets having an excellent contrast between the white background of the image-bearing surface and the resulting image itself.

These and other objects and advantages of the present invention will become apparent to those skilled in the art from a consideration of the following specification and claims.

SUMMARY OF THE INVENTION

In accordance with the present invention, it has been found that these and other objectives may be attained by employing a particular urea-formaldehyde resin pigment in the coated front surface (CF) of the carbonless paper.

The beneficial improvements obtained in accordance with this invention as a result of the use of the urea-formaldehyde resin pigment defined below appear to stem from an improved porosity in the surface coating. Hence, the urea-formaldehyde resin pigment acts like a transfer agent to help transfer the oil solution containing the color former material when the capsules are broken under pressure. Although not completely clear, the use of said urea-formaldehyde resin pigment most likely imparts a capillary action between the sheets of, for example, a manifold assembly and, moreover, helps to break up the normal clay surface on the CF sheet.

A suitable urea-formaldehyde resin pigment employed in accordance with the present invention is the urea-formaldehyde pigment described in U.S. Pat. No. 3,988,522 of Berstein, said pigment consisting essentially of a substantially water-insoluble, cross-linked urea-formaldehyde resin in highly dispersed particulate form. The BET specific surface urea of these particulate urea-formaldehyde pigments ranges from about 40 to about 75 square meters per gram, and the average agglomerate size of the pigments as commercially produced is about 2 to about 10 microns (although not limited thereto). A suitable agglomerate size for use in the present invention is about 7 to 9 microns. It is important to note that the urea-formaldehyde resin pigments used in the CF sheets in accordance with the present invention constitute agglomerated particles and that, for example, spherical particles will not provide the same unexpected benefits.

The molar ratio of urea to formaldehyde chemically combined in the structure of the pigments employed in the invention ranges from about 1:1.3 to about 1:1.8. Additionally, the internal structure of these pigments is highly cross-linked, rendering them essentially infusible and insoluble in water and thus quite different from ordinary fusible and/or water-soluble urea-formaldehyde condensation polymers.

These urea-formaldehyde pigments are prepared by reacting formaldehyde with urea in a molar proportion of urea to formaldehyde ranging from about 1:1.3 to about 1:1.8 in an aqueous solution, the amount of water in the reaction solution being at least equal to the total weight of the organic reactants therein. Suitable reaction temperatures are generally in the range of from about room temperature up to about 100° C., the most practical range of temperature being from about 40° C. up to about 85° C. Stirring or other agitation of the aqueous reaction medium is preferred, especially during the time when the insoluble, cross-linked pigments are being formed.

Relatively strong inorganic and/or organic acids having an ionization constant greater than $10^{-4}$, such as sulfuric acid, phosphoric acid, sulfamic acid or chloroacetic acid, are employed as a suitable cross-linking catalyst. The most preferred catalysts utilized for preparing the particular urea-formaldehyde resin pigments used in this invention are sulfamic acid and/or water-soluble ammonium acid sulfate salts, such as ammonium bisulfate.

The resulting insoluble pigment is recovered from the aqueous liquid by conventional techniques such as filtration, centrifugation and drying. As noted above, the obtained pigment is more or less agglomerated into various aggregates and gel-like granules. If necessary, the pigment may be comminuted by milling to obtain a suitable particle size.

Carbonless copy paper formulations per se are well known in the art and are described in, for example, U.S. Pat. No. 3,455,721, 3,723,156 and 3,732,120. Thus, in accordance with this invention, the described urea-formaldehyde resin pigment is employed in such formulations in an optimum amount of between about 1 to 25% by weight, in order to give better intensity of image and an improvement in the print speed of the resulting carbonless paper.

An important ingredient in these formulations is an oil-soluble metal salt of a phenol-formaldehyde novolak resin, for example, as described in U.S. Pat. No. 3,732,120 of Brockett et al and U.S. Pat. No. 3,737,410 of Mueller. Such novolak resins have been used in the art in making acid-reactant record material sheets capable of developing color in oil solutions of base-reacting colorless, chromogenic dye-precursor materials. An optimum additive of this type to be used in the present invention is a zinc-modified resin, more particularly, a zinc-modified, oil-soluble phenol-formaldehyde resin. Such metal resinate salts can be prepared by the reaction of an oil-soluble phenol-aldehyde resin, preferably a para-substituted-phenol-formaldehyde novolak resin, with the desired metal hydroxide or oxide. Alternatively, a water-soluble intermediate metal resinate may be made by treatment of the resin with a strong aqueous base, such as aqueous sodium hyroxide, to give an aqueous solution of sodium resinate, followed by treatment of the sodium resinate solution with an aqueous solution of a salt of a desired metal such as zinc chloride to bring about a precipitation of the desired metal resinate. The metal-modified resin may also be prepared by the reaction of an oil-soluble phenol-aldehyde novolak melt with a desired metal carboxylate or enolate.

In general, oily, colorless chromogenic dye precursors used in carbonless copy paper are solutions of solid, colorless, basic chromogenic dye precursors such as Crystal Violet Lactone (CVL) or Benzoyl Leuco Methylene Blue in oily vehicles encapsulated in gelatin capsules. Halogen-substituted aromatic hydrocarbons, alkylated aromatic hydrocarbons and dialkylphthalates are typical of the oils used as vehicles for the dye precursors. In a typical formulation, a clay such as kaolin, the zinc-modified resin, calcium carbonate (chalk), and a binder of styrene-butadiene latex and starch are admixed in water for coating onto a CF sheet. In the past, a typical substance for improving print intensity such as silica gel was employed in the formulation. However, such materials are themselves reacting with the dye and therefore provide a completely different mechanism of action as compared to the use of the white urea-formaldehyde resin pigments of this invention as a partial or total replacement for the calcium carbonate or other pigments. When a CF sheet in accordance with the invention is coupled with a conventional CB (coated back) sheet, an excellent pressure-sensitive record material is obtained.

The following examples are given merely as illustrative of the present invention and are not to be considered as limiting. Unless otherwise noted, the percentages, therein and throughout the application are by weight.

EXAMPLES OF THE INVENTION

EXAMPLE 1

An aqueous lurry containing 30–45% solids and comprising the components shown in Table I was prepared and coated by the use of a wire-wound rod on a CF paper base. The amounts shown are parts by weight on a dry basis.

The standard CB sheets used in the Examples herein comprise a paper substrate coated with gelatin capsules made in accordance with the procedure described in U.S. Pat. No. 3,041,289. They are formulated using a wheat starch stilt and a corn starch binder. The encapsulated dye mixture comprises an oily vehicle solution of 1.7% of Crystal Violet lactone, 0.55% of 3,3-bis(1-ethyl-2-methyl-indol-3-yl) phthalide (Indolyl Red), 0.55% of 2'-anilino-6'-diethylamino-3'-methylfluoran and 0.50% of benzoyl leuco methylene blue. The oily vehicle itself comprises 60% of ethyl diphenyl methane (U.S. Pat. No. 3,996,405), 30% of a saturated hydrocarbon oil (distillation range: 370°–500° F.) and 10% of a mixed phthalate ester.

TABLE I

| Sample No. | 1 | 2 | 3 | 4 | 5 | 6 |
|---|---|---|---|---|---|---|
| Kaolin clay | 68.35 | 65.35 | 65.35 | 61.35 | 56.35 | 46.35 |
| $CaCO_3$ | 3.0 | 3.0 | — | — | — | — |
| Zinc-modified phenol-formaldehyde resin (Durez Resin 28875, Hooker Chemical) | 12.0 | 12.0 | 12.0 | 12.0 | 12.0 | 12.0 |
| Urea Formaldehyde resin pigment (Cab-O-Lite 160, Cabot Corp.) | — | 3.0 | 6.0 | 10.0 | 15.0 | 25.0 |
| Starch | 9.4 | 9.4 | 9.4 | 9.4 | 9.4 | 9.4 |
| Styrene-butadiene latex binder | 7.25 | 7.25 | 7.25 | 7.25 | 7.25 | 7.25 |
| TOTAL | 100.0 | 100.0 | 100.0 | 100.0 | 100.0 | 100.0 |

In order to determine the transfer of oil with dye from a "CB Sheet" (sheet with Coated Back) to a "CF Sheet" (sheet with Coated Front) and therefore the intensity of the print obtained with the resulting carbonless copy paper, a Typewriter Intensity (TI) test is conducted. In this test a standard pattern is typed on a CF-CB pair. The reflectance of the printed area is a measure of color development on the CF sheet and is reported as the ratio of the reflectance of the printed area to that of the untyped area ($I/I_0$). A high value indicates little color development and a low value indicates good color development.

Correspondingly, a Calender Intensity (CI) test, which is essentially a rolling pressure test as opposed to the impact pressure of the TI test, is conducted to determine the amount of color developed from the transfer of dye obtained by such rolling pressure. Again, the results are reported as the ratio of the reflectance of the marks produced on the CF sheet as compared to the background reflectance of the paper ($I/I_0$).

The CI and TI tests results obtained with the samples of Table I with standard "NCR" CB sheets as described in U.S. Pat. No. 3,732,120, i.e., sheets coated with gelatin capsules containing oily solution droplets of the dye mixture described above, were as follows, the values given being indicative of the results noted at the stated times:

| Sample No. | 1 | 2 | 3 | 4 | 5 | 6 |
|---|---|---|---|---|---|---|
| CI (30 sec.–10 min.) | 54–51 | 53–49 | 52–49 | 47–46 | 44–23 | 41–40 |
| TI (20 min.–24 hrs.) | 41–41 | 36–36 | 33–33 | 32–32 | 27–27 | 23–23 |

EXAMPLE 2

The formulations given in Table II were coated on a CF paper sheet and tested for print intensity in the same manner as decribed in Example 1.

TABLE II

| Sample No. | 7 | 8 | 9 |
|---|---|---|---|
| Kaolin clay | 67.9 | 67.9 | 65.9 |
| $CaCO_3$ | 6.0 | — | — |
| Durez Resin 28875 | 13.6 | 13.6 | 13.6 |
| *Cab-O-Lite 100 (Cabot Corp.) | — | 6.0 | 8.0 |
| Starch | 6.5 | 6.5 | 6.5 |
| Latex | 6.0 | 6.0 | 6.0 |
| TOTAL | 100.0 | 100.0 | 100.0 |
| C.I. (15-30-60 sec. and 10 min.) | 48-47-46-46 | 45-45-44-43 | 45-44-44-43 |
| T.I. 20 min. | 40 | 35 | 33 |

*Urea-formaldehyde resin pigment

EXAMPLE 3

The formulations given in Table III were coated on a CF paper sheet and tested for print intensity in the same manner as described in Example 1.

TABLE III

| Sample No. | 10 | 1 | 12 |
|---|---|---|---|
| Kaolin clay | 67.9 | 65.9 | 65.9 |
| $CaCO_3$ | 6.0 | — | — |
| Durez Resin 28875 | 13.6 | 13.6 | 13.6 |
| *Cab-O-Lite 130 | — | 8.0 | — |
| *Cab-O-Lite 160 | — | — | 8.0 |
| Starch | 6.5 | 6.5 | 6.5 |
| Latex | 6.0 | 6.0 | 6.0 |
| TOTAL | 100.0 | 100.0 | 100.0 |
| C.I. (15-30-60 sec. and 10 min.) | 48-47-46-45 | 46-45-45-44 | 45-45-44-44 |
| T.I. (20 min.-24 hrs.) | 35-36 | 32-32 | 30-31 |

*Urea-formaldehyde resin pigment

EXAMPLE 4

The formulations given in Table IV were coated on a CF paper sheet and tested for print intensity in the same manner as described in Example 1.

TABLE IV

| Sample No. | 13 | 14 |
|---|---|---|
| Kaolin clay | 63.3 | 63.9 |
| $CaCO_3$ | 6.0 | — |
| Durez Resin 28875 | 16.2 | 13.6 |
| *Cab-O-Lite 160 | — | 8.0 |
| Starch | 8.5 | 8.5 |
| Latex | 6.0 | 6.0 |
| TOTAL | 100.0 | 100.0 |
| C.I. (15-30-60 sec. and 10 min.) | 48-47-46-46 | 47-45-44-44 |
| T.I. (20 min.-24 hrs.) | 36-35 | 29-29 |

*Urea-formaldehyde resin pigment

As can be seen from the above data, the urea-formaldehyde resin pigment, when used in the CF coating, improves the reactivity of the CF surfaces. The primry difference among the different types of urea-formaldehyde resin pigments is the particle size of the pigment particles. In every case, however, significant improvement of the intensity (reactivity) and especially in the print speed, i.e., obtaining a higher intensity of color development ($I/I_0$) in a shorter period of time, are obtained with the use of the urea-formaldehyde resin pigments.

EXAMPLE 5

The formulations given in Table V were coated on a CF paper sheet and tested for print intensity in the same manner as described in Example 1.

TABLE V

| Sample No. | 15 | 16 | 17 |
|---|---|---|---|
| Kaolin clay | 67.9 | 81.5 | 81.5 |
| $CaCO_3$ | 6.0 | — | 6.0 |
| *Cab-O-Lite 130 | — | 6.0 | — |
| Durez Resin 28875 | 13.6 | — | — |
| Starch | 6.5 | 6.5 | 6.5 |
| Latex | 6.0 | 6.0 | 6.0 |
| TOTAL | 100.0 | 100.0 | 100.0 |
| C.I. (30 sec.-24hrs.) | 51-49 | 88-86 | 89-89 |
| T.I. (20 min.-24hrs.) | 40-39 | 81-78 | 82-78 |

*Urea-formaldehyde resin pigment

EXAMPLE 6

An experimental production run was conducted in the plant utilizing the formulation as shown in Table VI. A control run without the addition of urea-formaldehyde resin pigment was also carried out for comparison purposes. Print intensity tests were conducted in the same manner as described in Example 1. The results are shown in Table VI. As in the foregoing Examples, the amounts shown are parts by weight on a dry basis.

TABLE VI

| Sample No. | Control | A |
|---|---|---|
| Kaolin clay | 67.9 | 64.9 |
| Ansilex clay (U.S. Pat. No. 3,586,523) | — | 3.0 |
| $CaCO_3$ | 6.0 | — |
| Durez Resin 28875 | 13.6 | 12.6 |
| *Cab-O-Lite 160 | — | 6.0 |
| Starch | 6.5 | 7.5 |
| Latex | 6.0 | 6.0 |
| TOTAL | 100.0 | 100.0 |
| C.I. (30 sec.-24 hrs.) | 54.2-51.7 | 49-44.3 |
| T.I. (20 min.-24 hrs.) | 38-38 | 32-33 |

*Urea-formaldehyde resin pigment

EXAMPLE 7

Using the same formulations as set forth in Example 6, except that Cab-O-Lite 130 was employed, several trial production runs were carried out to obtain CF sheets containing Cab-O-Lite 130 urea-formaldehyde resin pigments. The average C.I. test values obtained therewith are shown in Table VII.

TABLE VII

| | C.I. (Average) | |
|---|---|---|
| Sample No. | 30 sec. | 24 hrs. |
| Control (No Cab-O-Lite pigment) | 54.2 | 51.7 |
| B | 50.9 | 47.1 |
| C | 52.1 | 46.0 |
| D | 51.3 | 47.7 |
| E | 51.2 | 47.7 |
| F | 53.2 | 47.7 |
| G | 52.9 | 47.8 |

EXAMPLE 8

Transfer efficiency studies were conducted to determine the effect of the inclusion of the urea-formaldehyde resin pigment in the CF sheets with respect to the amount of oily dye precursor transferred from conventional CB sheets in a carbonless copy paper record material. In this test a CF-CB couple is passed at a rate of 30 cm/sec through calender rolls calibrated to apply pressures of from 1050 psi to 4500 psi. The CB/CF sandwich is passed through the calender nip at the desired pressure, and the weight of internal phase solution transferred from the CB sheet to the CF sheet is determined. The resulting colored area on the CF sheet is measured and the mg. of oil per $cm^2$ transferred to the CF sheet is calculated. After development of maximum intensity thereon (following storage in the dark for at least 4 hours but not over 24 hours), the $I/I_0$ of the colored CF sheet is read with an opacimeter. The $I/I_0$ values are converted to a Kubelka Munk Function, which indicates the amount of surface color.

Typical test results are shown in Table VIII.

TABLE VIII

| | Calender roll pressure (psi) | Oil transferred ($mg/cm^2$) | C.I. | Kubelka Munk Function |
|---|---|---|---|---|
| [a]Sample No. 15 (Control; no Cab-O-Lite) | 1050 | 0.016 | 76.1 | 0.0375 |
| | 1600 | 0.029 | 61.5 | 0.1205 |
| | 2010 | 0.039 | 50.4 | 0.2441 |
| | 2580 | 0.055 | 39.7 | 0.4579 |
| | 3170 | 0.070 | 33.4 | 0.6640 |
| | 4040 | 0.083 | 29.6 | 0.8372 |
| | 4600 | 0.088 | 28.6 | 0.8913 |
| [b]Sample No. A (contains Cab-O-Lite 160) | 1050 | 0.017 | 73.5 | 0.0478 |
| | 1600 | 0.030 | 55.5 | 0.1784 |
| | 2010 | 0.046 | 45.9 | 0.3188 |
| | 2580 | 0.065 | 34.6 | 0.6181 |
| | 3170 | 0.081 | 29.5 | 0.8424 |
| | 4040 | 0.101 | 25.9 | 1.0600 |
| | 4600 | 0.110 | 24.5 | 1.1633 |
| [c]Sample No. B (contains Cab-O-Lite 130) | 1050 | 0.016 | 72.3 | 0.0531 |
| | 1600 | 0.032 | 57.2 | 0.1601 |
| | 2010 | 0.048 | 46.8 | 0.3024 |
| | 2580 | 0.065 | 35.6 | 0.5825 |
| | 3170 | 0.084 | 30.3 | 0.8017 |
| | 4040 | 0.094 | 25.8 | 1.0670 |
| | 4600 | 0.109 | 25.0 | 1.1250 |

[a]CF formulation recited in Example 5
[b]CF formulation recited in Example 6
[c]CF formulation recited in Example 7

Conventional "NCR" CB sheets coated with gelatin capsules containing oily solution droplets of dye were used; see Example 1.

The above data show that the addition of the urea-formaldehyde resin pigment to the CF sheets generally provides an increase in the amount of oil-containing dye precursor transferred to the CF sheet but, more importantly, a significant improvement in the transfer efficiency, i.e., the amount of surface color obtained, as compared with the control CF sheets containing no urea-formaldehyde resin pigment therein.

The invention being thus described, it will be obvious that the same may be varied in many ways. Such variations are not to be regarded as a departure from the spirit and scope of the invention, and all such modifications are intended to be included within the scope of the following claims.

We claim:

1. A pressure-sensitive record sheet material comprising a first substrate having a coating of pressure rupturable capsules containing an oily solution of a colorless chromogenic dye precursor and in contiguous relationship therewith a second substrate having a coating comprising kaolin clay, an oil-soluble zinc-modified phenol-formaldehyde resin, about 1 to 25% by weight of a substantially water-insoluble, cross-linked urea-formaldehyde agglomerated resin pigment having a mean agglomerate size of from about 2 to about 10 microns and a latex or starch binder therefor.

2. The pressure-sensitive record sheet material in accordance with claim 1, wherein said substrate is a paper sheet.

3. The pressure-sensitive record sheet material in accordance with claim 1, wherein said binder is a styrene-butadiene latex.

4. The pressure-sensitive record sheet material in accordance with claim 1, wherein said formulation further includes calcium carbonate.

5. The pressure-sensitive record sheet material in accordance with claim 1, wherein said formulation includes starch and a latex.

6. The pressure-sensitive record sheet material in accordance with claim 1, wherein the first and second substrates are paper sheets.

7. A manifold assembly comprising a plurality of coated first and second substrates as defined in claim 1.

8. A pressure-sensitive record sheet material which comprises a substrate coated with a formulation comprising kaolin clay, an oil-soluble metal salt of a phenol-formaldehyde resin, about 1 to 25% by weight of a substantially wateer-insoluble, cross-linked urea-formaldehyde agglomerated resin pigment having a mean agglomerate size of from about 2 to about 10 microns, and a latex or starch binder therefor.

9. The pressure-sensitive record sheet material in accordance with claim 8, wherein the phenol-formaldehyde resin salt is a zinc-modified phenol-formaldehyde resin.

10. The pressure-sensitive record sheet material in accordance with claim 8, wherein said urea-formaldehyde resin pigment has a mean agglomerate size of from about 7 to about 9 microns.

11. The pressure-sensitive record sheet material in accordance with claim 8, wherein the BET specific surface area of said urea-formaldehyde resin pigment is about 40 to about 75 square meters per gram.

12. The pressure-sensitive record sheet material in accordance with claim 8, wherein the molar ratio of urea to formaldehyde in said urea-formaldehyde resin pigment is from about 1:1.3 to about 1:1.8.

* * * * *